United States Patent [19]

Hoshino

[11] 4,230,014

[45] Oct. 28, 1980

[54] SECUREMENT OF GUITAR BRIDGE TO GUITAR BODY

[75] Inventor: Yoshihiro Hoshino, Nagoya, Japan

[73] Assignee: Hoshino Gakki Ten, Inc., Japan

[21] Appl. No.: 1,699

[22] Filed: Jan. 8, 1979

[51] Int. Cl.[3] ..... G10D 3/04

[52] U.S. Cl. ..... 84/299

[58] Field of Search ..... 84/298, 299, 307

[56] References Cited

U.S. PATENT DOCUMENTS

| | | | |
|---|---|---|---|
| 2,491,991 | 12/1949 | Lundback | 84/307 |
| 2,740,313 | 4/1956 | McCarty | 84/298 X |
| 3,605,545 | 9/1971 | Rendell | 84/307 |

*Primary Examiner*—Lawrence R. Franklin

[57] ABSTRACT

A guitar bridge including a main body having adjustable support plates over which the guitar strings pass under tension. The main body of the guitar bridge is secured to an installation block which is, in turn, secured to the body of the guitar. The securement of the main body of the guitar bridge to the installation block is by way of an installation screw which is screwed into the support stand inside the body of the guitar. The upper end of the installation screw is domed and the receiving opening for the installation screw in the main body of the guitar bridge is correspondingly domed. A screw threaded extension up from the domed end of the installation screw is received by a tightening nut near the top of the guitar bridge and tightening of that nut on the extension of the installation screw tightens the installation screw into the domed opening in the guitar bridge main body.

10 Claims, 7 Drawing Figures

SECUREMENT OF GUITAR BRIDGE TO GUITAR BODY

This invention relates to the bridge of a guitar and more particularly to an apparatus for securing the bridge to the guitar.

BACKGROUND OF THE INVENTION

A guitar, and more particularly an electric guitar, is a stringed musical instrument where the strings extend from a tail piece at the rear of the guitar, over an elevated bridge to the peg head of the guitar. The bridge of the guitar is secured to the body of the guitar and is typically slightly elevated with respect to the tail piece and the peg head so that the strings are deflected slightly as they pass over the guitar bridge.

One form of guitar bridge comprises a relatively thick body which has a plurality of recesses defined in it. An upstanding guitar string support plate is supported in each of the recesses. The edge of the plate projects up out of the recess. A respective guitar string passes over and is supported by each plate. By appropriate screw adjustment means, or the like, provided in the guitar bridge, each support plate is movable across its recess from the front end closer to the peg head to the rear end closer to the tail piece, for correct adjustments in string length, tone quality, etc.

At the ends of the guitar bridge are defined holes that receive respective support members and the support members are adjusted to hold the guitar bridge off the surface of the guitar body by a fixed distance. The tension of the guitar strings helps to maintain the bridge thus fashioned in position. In the arrangement just described, the guitar bridge is not integrally fixed to the main body of the guitar. As a result, the guitar bridge moves with the vibration of the guitar strings as the guitar is used. This causes the tuning of the strings to be shifted. Furthermore, it is desirable to obtain a trailing sound that stems from the vibration of the strings. With a guitar bridge thus supported, no satisfactory trailing sound is obtained. Furthermore, over time, the guitar strings will become damaged due to the friction between the above-mentioned support plates for the strings and the strings themselves as a result of the shifting of the guitar bridge when the strings are plucked.

SUMMARY OF THE INVENTION

Accordingly, it is the primary object of the present invention to avoid the foregoing drawbacks of known guitar bridges.

It is another object of the invention to provide a guitar bridge which does not vibrate or shake during use of the guitar.

It is another object of the invention to eliminate shifting of the tuning while the guitar is being played.

It is a further object of the invention to produce a satisfactory sound without eliminating the trailing sounds that stem from the vibration of the strings.

It is yet another object of the present invention to reduce damage to guitar strings due to vibration of the guitar bridge.

It is a further object of the invention to adequately fasten the guitar bridge to the guitar body.

According to the invention, with a guitar bridge having many or all of the characteristics noted above, and in particular, having a respective support plate for each guitar string projecting up from the bridge, whether or not the support plate itself is intended to be adjustable, the body of the guitar bridge is attached to an appropriate support stand which is integrated with the body of the guitar, for fixing and holding the guitar bridge and the guitar body as one integral body, thereby to adequately transmit the vibrations of the guitar string to the guitar body and achieve the objects of the invention.

Particular tightening members are used for securing the guitar bridge to its support stand. A tightening member comprises a screw which at one end is secured in a height adjustable manner to the support stand. The end of the screw extending into the guitar bridge has a widened portion that is topped by a rounded dome surface. A narrow, screw threaded extension extends up from the dome surface, through the guitar bridge and is tightened there to the body of the guitar bridge by a nut. The receiving hole for the tightening member screw in the guitar bridge body is correspondingly shaped.

Other objects and features of the invention will become apparent from the following detailed description of the invention considered with reference to the accompanying drawings.

DESCRIPTION OF A PREFERRED EMBODIMENT

Figure 1:
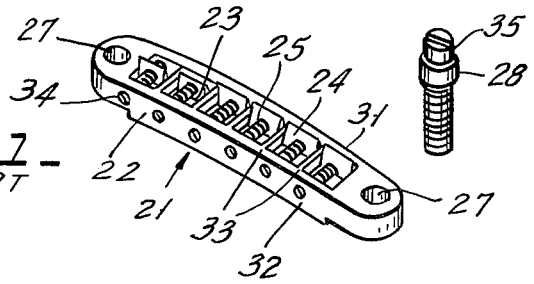
FIG. 1 PRIOR ART
FIG. 1 is a perspective view showing a conventional guitar bridge and a separated support member therefor.
Figure 2:
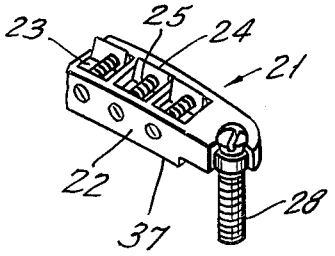
FIG. 2 PRIOR ART
FIG. 2 is a fragmentary view of the same guitar bridge with the support member in place.

First, a prior art guitar bridge 21 will be described with reference to FIGS. 1 and 2. The guitar bridge 21 includes a main body 22 which is supported on the body of a guitar at the support element receiving holes 27 at the sides of the bridge. The body 22 of the bridge is relatively wide between its front 31 and its back 32 (its narrow dimension). A plurality of recesses 23 are defined in the main body 22. Adjacent recesses are separated by respective upstanding dividing walls 33 defined in the bridge main body 22. A respective guitar string support plate 24 is provided in each of the recesses 23. It is rectangular in shape to contact the side walls 33 of the respective recess for maintaining the illustrated erect orientation of the plates 24. Each of the support plates 24 is carried on a fixedly positioned, but rotatable, bolt 25 that extends between supporting holes 34 therefor at the front 31 and rear 32 walls of the main body 22. Each of the screws 25 is rotatable, but does not shift longitudinally when it is rotated. However, the rotation of a screw 25 moves the respective plate 24 forward or backward in its recess 23.

Each side end of the guitar bridge main body 22 is provided with a support member receiving a hole 27. A respective screw threaded support member 28 is provided for each of the opposite side ends of the guitar bridge 27. The opening 27 fits over the upper end 35 of the respective screw 28 therefor and the respective screw support member 28 extends down at 36 to the guitar body (not shown). Typically, the support member 28, as shown in FIG. 2, extends down below the bottom 37 of the main body 22 and when the support member 28 is installed in the guitar body, the support member 28 holds the bridge off the top surface of the guitar body by a fixed, perhaps relatively short, distance. The tension of the guitar strings (not shown in FIGS. 1 and 2) passing over the support plates 24 helps maintain the guitar bridge 21 in its fixed position at the height established by the support members 28.

As discussed above in the background of the invention, because the guitar bridge 21 is not integrally fixed to the guitar body, the guitar bridge also moves or vibrates with the strings, perhaps shifting the tuning of the strings and also preventing satisfactory trailing sound to be produced by the vibration of the strings. Furthermore, the strings may be damaged due to friction between the support plate 24 and strings which stems from the movement of the guitar bridge 21 during use of the guitar.

Figure 3:
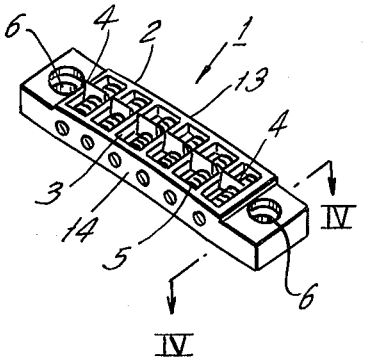
FIG. 3 is a perspective view of a guitar bridge according to the invention.
Figure 4:
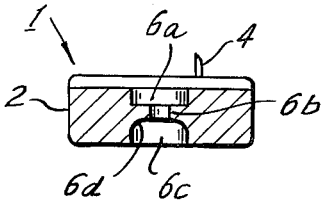
FIG. 4 is a cross-section of the guitar brige along the line IV—IV of FIG. 3.

According to the invention, as shown in FIGS. 3 and 4, the guitar bridge 1 also includes a plurality of recesses 3, one for each of the strings of the guitar and being provided in a relatively thicker (front 13 to rear 14) main body 2, which main body is even thicker than the main body 22 of the prior art guitar bridge 21. The support plates 4 for each guitar string 10 (shown in FIG. 7) are also carried on respective screws 5. The plates 4 and screws 5 therefor have the characteristics of the plates and screws 24 and 25.

At both ends of the main body 2 of the guitar bridge 1, a respective support hole 6 is provided which runs vertically through the body. With reference to FIG. 4, the support hole 6 has a three stage structure, including an upper widened opening **6*a* for receiving an installation screw tightening nut 7, described below, a narrowed intermediate portion 6*b* and a lower opening 6*c* which has an upper terminal face 6*d* that is in the form of a domed or curved surface which conforms to the shape of the upper part of an installation screw 8**, also described below.

Figure 5:
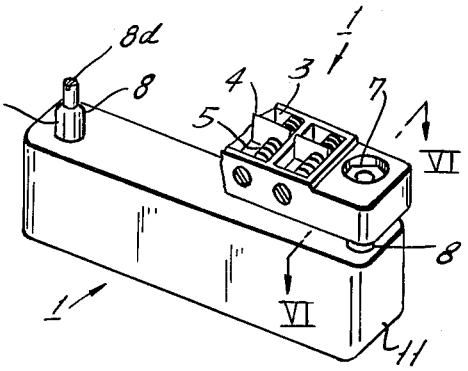
FIG. 5 is a perspective view showing the guitar bridge of the invention held in position on its support.
Figure 6:
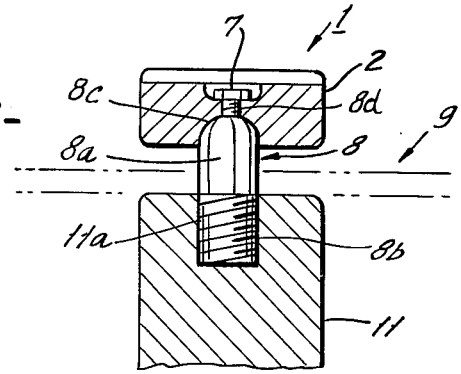
FIG. 6 is a cross-sectional view along the line VI—VI of FIG. 5.

With reference to FIGS. 5 and 6, an installation screw 8 is provided for each of the support holes 6. The installation screw 8 comprises a lower, cylindrically shaped portion which includes an upper knurled section **8*a* and a lower section 8*b*, which is externally screw threaded for being received in a below described support stand 11. The upper end 8*c* of the lower portion 8*a* of the screw 8 is cooperatingly domed or curvedly shaped to conform to the curvature of the domed surface 6*d* of the opening 6. Projecting above the domed portion 8*c* of the screw 8 is a narrowed diameter cylindrically shaped, screw threaded element 8*d* which is narrow enough to fit through the narrowed intermediate portion 6*b* of the opening 6 and which is received in the matingly screw threaded nut 7 that is located in the upper recess 6*a* of the opening 6. Tightening of the nut 7 secures the screw 8 to the guitar bridge main body 2 and assure that the domed surfaces 6*c*, 8*d*** are secured together.

The screw threaded lower section **8*b* of the installation screw 8 is received in cooperatingly threaded apertures 11*a* in the support stand 11**.

Figure 7:
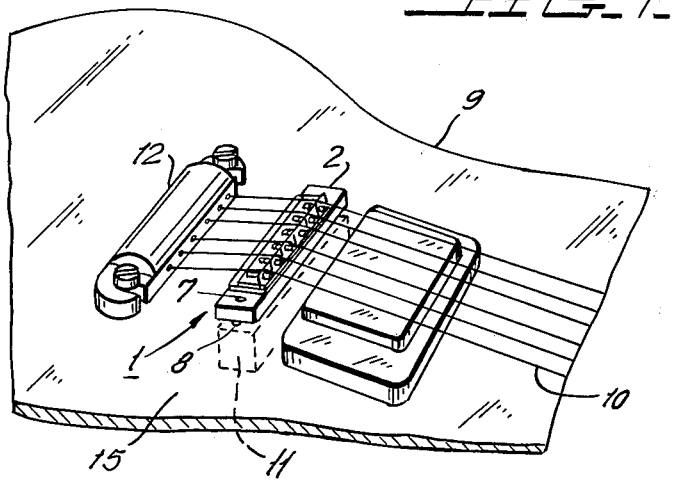
FIG. 7 shows a fragment of a guitar with the guitar bridge in place.

With reference to FIGS. 6 and 7, the support stand 11 comprises a block of substantially the front to back thickness and width of the guitar bridge and it is located beneath and is secured to the underside of the top 15 of the guitar body 9. The guitar body top has holes therethrough through which the screws 8 pass so that the screws 8 may be received in the support stand 11. Any vibration of the support stand 11 caused by the guitar bridge is transmitted to the guitar body 9. At the same time, the support stand secured to the guitar body damps undesired vibration of the guitar bridge. The height of the guitar bridge and thus of the guitar strings off the body of the guitar is determined by adjustment of the height of the screw 8 with respect to the support stand 11. Thereafter, the guitar bridge main body 2 is applied over the screws 8. The tightening of the nut 7 on the screw 8 firmly secures the guitar bridge 1 to the screws 8 due to the cooperation between the curved surfaces **6*d* and 8*c* of the support hole 6 and the screw 8, respectively. As shown in FIG. 7, the guitar strings 10 extend from the illustrated tail piece 12 over the guitar bridge 1** and extend to a peg head (not shown).

In view of the foregoing, the guitar bridge 1 is integrally fixed to the main body 9 of the guitar. The rounded upper surface of the installation screw and the correspondingly curved surface inside the support hole of the guitar bridge ensures better securement against guitar bridge shifting and vibration. The securement prevents shaking of the guitar bridge resulting from vibration of the strings during use of the guitar. There is no shifting of the tuning and since vibration can be transmitted directly to the main body from the guitar bridge, a trailing sound stemming from the vibration of the strings is realized, thereby satisfactorily prolonging the musical sounds during the musical performance. Furthermore, there is reduced wear of the strings 10 by the support plates 4.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What we claim is:

1. A guitar bridge, comprising:

a main body; a support for each guitar string at the top of said main body;

two vertically extending support holes defined in said main body, each for receiving a respective guitar bridge tightening shaft;

a said respective guitar bridge tightening shaft at each said support hole for securing said bridge to a body of a guitar; each said shaft having an upwardly facing top end; each said support hole in said main body having a downwardly facing top end portion inside said main body and which is profiled for engaging said shaft top end, and said bridge and said shaft being held securely together with engagement between said shaft top end and said main body top end portion; additional shaft securement means connecting said shaft and said main body for securing said shaft top end and said support hole top and portion together;

said tightening shaft including attaching means for attaching said tightening shaft to a guitar body.

2. The guitar bridge of claim 1, wherein said additional shaft securement means comprises a narrower diameter screw, which is narrower than said shaft top end, projecting up from said shaft top end; a nut held in said main body above said support hole top end; said nut being tightened over said narrower diameter screw of said shaft, thereby to draw said shaft top end and said support hole top end portion together.

3. The guitar bridge of claim 2, wherein said shaft top end and said support hole top end portion are matingly curvedly dome shaped and are secured together.

4. The guitar bridge of claim 3, wherein said shaft top end is convexly curved and said support hole top end portion is concavely curved.

5. In combination, the guitar bridge of either of claims 1 or 3 and a support stand; a respective opening in said stand for receiving each said tightening member shaft top end and for permitting said narrower diameter screw to project up; said tightening member attaching means being secured to said support stand; said support stand being adapted to be secured to a guitar body.

6. In combination, the combination of claim 5 and a guitar; said guitar including a guitar body; said stand being secured to said guitar body.

7. The combination of claim 5, wherein said tightening member attaching means is adjustable with respect to said support stand for adjusting the height of said guitar bridge over a guitar body.

8. The combination of claim 7, wherein each said opening in said stand is screw threaded and the respective said tightening member attaching means is screw threaded as it extends into its said stand opening, whereby adjustment of the height of said guitar bridge over said stand is obtained by rotation of each said tightening member with respect to said support stand.

9. The combination of claim 8 and a guitar; said guitar including a guitar body; said stand being secured to said guitar body.

10. The guitar bridge of claim 1, wherein said guitar bridge main body includes a top side with a respective recess defined therein over which a respective guitar string passes; a respective support plate in each said recess and projecting up from the top thereof over which the respective guitar string passes in engagement; means associated with each said support plate on said guitar bridge for enabling adjustment of the position of the guitar string support plate between the forward and rearward sides of the recess therefor.

* * * * *